US010801481B2

(12) United States Patent
Yang

(10) Patent No.: US 10,801,481 B2
(45) Date of Patent: Oct. 13, 2020

(54) AIR BAG ASSEMBLY WITH PUMPING FUNCTION

(71) Applicant: Universal Trim Supply Co., Ltd., New Taipei (TW)

(72) Inventor: Shih-Sheng Yang, Taipei (TW)

(73) Assignee: Universal Trim Supply Co., Ltd., New Taipei (TW)

( * ) Notice: Subject to any disclaimer, the term of this patent is extended or adjusted under 35 U.S.C. 154(b) by 28 days.

(21) Appl. No.: 16/274,206

(22) Filed: Feb. 12, 2019

(65) Prior Publication Data

US 2020/0200159 A1 Jun. 25, 2020

(30) Foreign Application Priority Data

Dec. 20, 2018 (CN) ..... 2018 1 1563813

(51) Int. Cl.
*F04B 37/14* (2006.01)
*F04B 39/00* (2006.01)

(52) U.S. Cl.
CPC ..... *F04B 37/14* (2013.01); *F04B 39/00* (2013.01)

(58) Field of Classification Search
CPC ..... F04B 37/14; F04B 39/00; F04B 39/10; F04B 33/00; F04B 45/06; F04B 45/02; B65B 1/04; B65B 1/18
USPC ..... 141/65, 68
See application file for complete search history.

(56) References Cited

U.S. PATENT DOCUMENTS 2,604,297 A * 7/1952 Winstead ..... F16K 15/202 137/223
2003/0145888 A1* 8/2003 Lin ..... A43B 13/203 137/223
2011/0293454 A1* 12/2011 Yang ..... F04B 33/00 417/480
2014/0241922 A1* 8/2014 Yang ..... F04B 45/04 417/472

* cited by examiner

*Primary Examiner* — Timothy P. Kelly
*Assistant Examiner* — Stephanie A Shrieves
(74) *Attorney, Agent, or Firm* — Winston Hsu

(57) ABSTRACT

An air bag assembly includes an air bag having a first hole, a suction pump, a rotary cover and a first check valve. A pump body of the suction pump is deformable and provided with a second air hole. The rotary cover includes an air outlet communicating with the second air hole. A convex part and a concave part of the rotary cover are configured to engage with a concave portion and a convex portion of the pump body, respectively. The first check valve allows air to enter into the interior of the pump body from the interior of the air bag through the first air hole. The air bag can be pumped by rotating the rotary cover. The air bag assembly has advantages of simple operation, small volume and low requirement on operating space, and capable of being assembled on other objects, which is convenient to use and carry.

10 Claims, 10 Drawing Sheets

AIR BAG ASSEMBLY WITH PUMPING FUNCTION

CROSS REFERENCE TO RELATED APPLICATIONS

This application claims the benefit of China Application No. 201811563813, filed on Dec. 20, 2018, and the entire contents of this application are hereby incorporated by reference.

BACKGROUND OF THE INVENTION

1. Field of the Invention

The present invention relates to an air bag assembly, and more particularly, to an air bag assembly with advantages of simple operation, small volume and low requirement on operating space, and capable of being assembled on other objects, which is convenient to use and carry.

2. Description of the Prior Art

In an existing manual air suction device, a bag body is often pumped by pulling a piston in an air cylinder, such as vacuuming a clothes storage bag by the air cylinder. However, it needs large action of operation during the pumping process, which requires sufficient space, and the pumping cylinder makes the air suction device bulky. Therefore, the existing manual air suction device is only suitable for use alone, and it is inconvenient to be assembled on other objects. At present, there is no air suction product on the market, which is small in size, has low requirement on operating space, and is convenient to be assembled on other objects.

In addition, retractable parts are generally used in clothing, shoes, bags and other daily items to adjust a size of an object. For example, sports shoes are equipped with shoe straps to tie and adjust the tightness of the sports shoes to ensure safety of the ankles. An elastic waist strap or rope is sewed on the waistband of the trousers to adjust the tightness. A corset waistband for body shaping is elastically stretched. Mesh bags for containing water bottles on both sides of a backpack are provided with elastic rubber bands, and the elastic rubber bands are used to tighten bag mouths of the mesh bags to fix the water bottles in the mesh bags. However, the above-mentioned retractable parts mainly have following defects. The shoelace or the rope needs to be knotted to tighten the object, the knot is easy to loosen, and the knot needs to be repeated after loosening, so the operation is complicated and inconvenient. The elastic band and the elastic stretching fabric can be stretched and contracted and are convenient to use, but it is prone to elastic fatigue after a long time of use and loses elasticity. At present, there is no product on the market that is easy to use, has no elastic fatigue, and can be adjusted to tighten by pumping.

SUMMARY OF THE INVENTION

Therefore, an objective of the present invention is to provide an air bag assembly with advantages of simple operation, small volume and low requirement on operating space, and capable of being assembled on other objects, which is convenient to use and carry.

In order to achieve the aforementioned objective, the present invention discloses an air bag assembly including an air bag whereon a first hole is formed. The air bag assembly further includes a suction pump disposed outside the air bag and covering the first air hole. A middle portion of the suction pump bulges outwardly to form a pump body, a peripheral edge of the pump body is sealingly connected to the air bag, the pump body is deformable and provided with a second air hole, an interior of the pump body is communicated with an interior of the air bag through the first air hole, and a concave portion and a convex portion are formed on an outer surface of the pump body. The air bag assembly further includes a rotary cover disposed outside the suction pump. The rotary cover includes an air outlet communicating with the second air hole, a peripheral edge of the rotary cover is sealingly connected to the air bag, a concave part and a convex part are formed on an inner surface of the rotary cover, the convex part and the concave portion are configured to engage with each other, and the concave part and the convex portion are configured to engage with each other. The air bag assembly further includes a first check valve for controlling opening and closing of the first air hole and further for only allowing air to enter into the interior of the pump body from the interior of the air bag through the first air hole. When the rotary cover is rotated to make the convex part press the convex portion, the first check valve closes the first air hole, and air inside the pump body is sequentially discharged through the second air hole and the air outlet hole. When the rotating cover is rotated to make the convex part embed in the concave portion and make the convex portion embed in the concave part, the first check valve opens the first air hole, and air inside the air bag passes through the first air hole to enter into the interior of the pump body, so as to pump the air bag by rotating the rotary cover.

The air bag assembly of the present invention is provided with the rotary cover, and the pump body is pressed by rotating the rotary cover to pump the air bag. The pumping operation is simple, the volume of the rotary cover is smaller than a conventional manual air pumping cylinder, and the rotational operation action is small, which only requires small space, so that the rotary cover can be directly installed on the air bag. The air bag assembly of the present invention can be installed on other objects, which is convenient to use and carry.

Specifically, the air bag assembly further includes a second check valve for controlling opening and closing of the second air hole and further for only allowing air to enter into an interior of the rotary cover from the interior of the pump body through the second air hole. When the rotary cover is rotated to make the convex part of the rotary cover press the convex portion of the pump body, the second check valve opens the second air hole. And then, when the rotating cover is rotated to make the convex part of the rotary cover embed in the concave portion of the pump body and make the convex portion of the pump body embed in the concave part of the rotary cover, the second check valve closes the second air hole. By setting double check valves, the vacuum suction force of the pump body applied to the air bag can be ensured, and the pumping speed of the air bag can be accelerated.

Specifically, a diameter of the first air hole is larger than a diameter of the second air hole. It can reduce air backflow to the interior of the pump body and make more air inside the air bag pump to the interior of the pump body.

Specifically, the air bag is a flat sealing body formed by laminating an upper piece and a lower piece, the upper piece is bent to form at least one inverted V-shaped groove, the lower piece is bent to form at least one V-shaped groove corresponding to the at least one inverted V-shaped groove, a notch of each of the at least one inverted V-shaped groove and a notch of the corresponding V-shaped groove are engaged with each other to format least one sealing passage having a rhombic cross section, and the at least one sealing passage is connected to the first air hole.

Specifically, a diagonal length of the rhombic cross section vertical to the airbag is greater than a diagonal length of the rhombic cross section parallel to the air bag when an interior of the at least one sealing passage is at a normal pressure. The rhombic cross section can be laterally contracted when pumping, the sealing passage can be laterally actuated, and the air bag can realize lateral expansion and contraction. The pumping amount of the air bag can be adjusted for achieving the function of adjusting the tightness. The air bag assembly can be used as a retractable component applied for wearable accessories.

Specifically, the diagonal length of the rhombic cross section vertical to the air bag is greater than or equal to $\sqrt{3}$ times the diagonal length of the rhombic cross section parallel to the air bag when the interior of the at least one sealing passage is at the normal pressure, so as to facilitate the expansion and contraction of the air bag.

Specifically, a plurality of the sealing passages are spaced on the air bag, and two adjacent sealing passages are parallel to each other. Therefore, the air bag can be contracted in a direction perpendicular to the sealing passage when being exhausted, and the airbag can be expanded in the direction perpendicular to the sealing passage when being inflated.

Specifically, a gauze layer is disposed between the upper piece and the lower piece, so as to accelerate circulation of the air inside the air bag.

Specifically, the suction pump is made of silicone material, which is easy to recover after deformation.

Specifically, a venting valve is disposed on the air bag, so as to facilitate recovery of an internal pressure of the air bag to the normal pressure.

These and other objectives of the present invention will no doubt become obvious to those of ordinary skill in the art after reading the following detailed description of the preferred embodiment that is illustrated in the various figures and drawings.

DETAILED DESCRIPTION

In the following detailed description of the preferred embodiments, reference is made to the accompanying drawings which form a part hereof, and in which is shown by way of illustration specific embodiments in which the invention may be practiced. In this regard, directional terminology, such as "top," "bottom," "front," "back, " etc., is used with reference to the orientation of the Figure(s) being described. The components of the present invention can be positioned in a number of different orientations. As such, the directional terminology is used for purposes of illustration and is in no way limiting. Accordingly, the drawings and descriptions will be regarded as illustrative in nature and not as restrictive.

Figure 1:
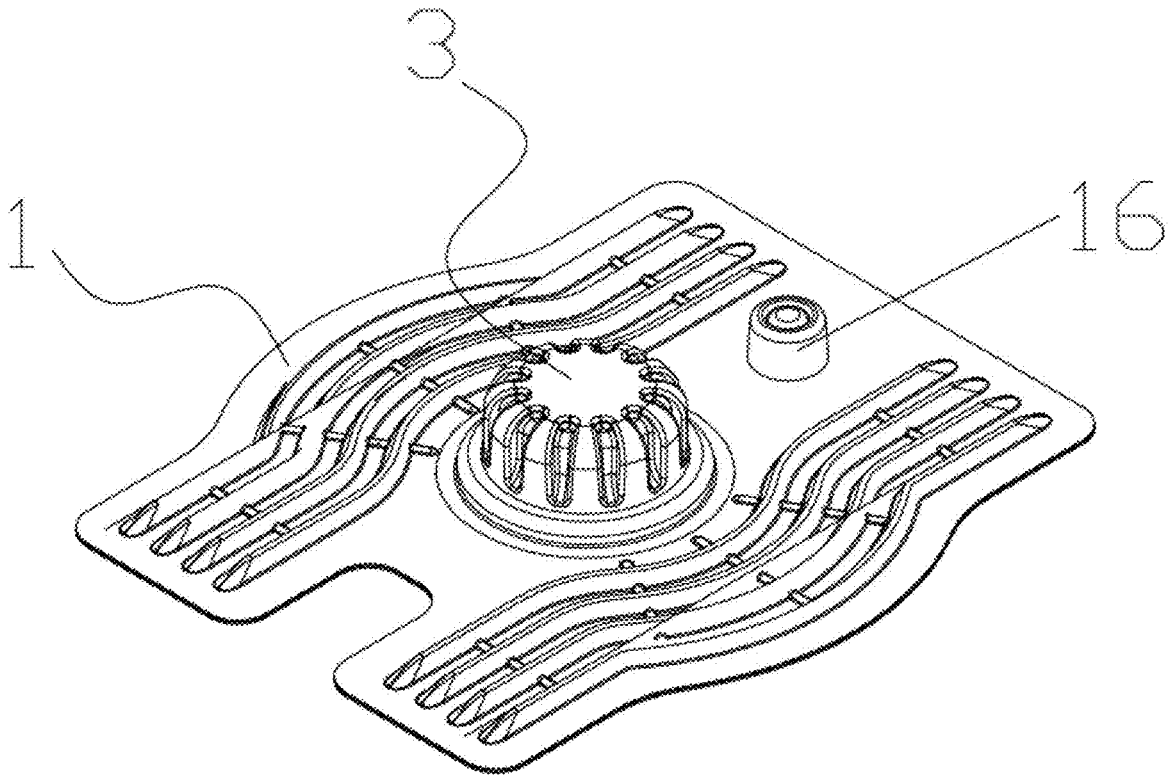
FIG. 1 is a schematic diagram of an air bag assembly of the present invention.
Figure 2:
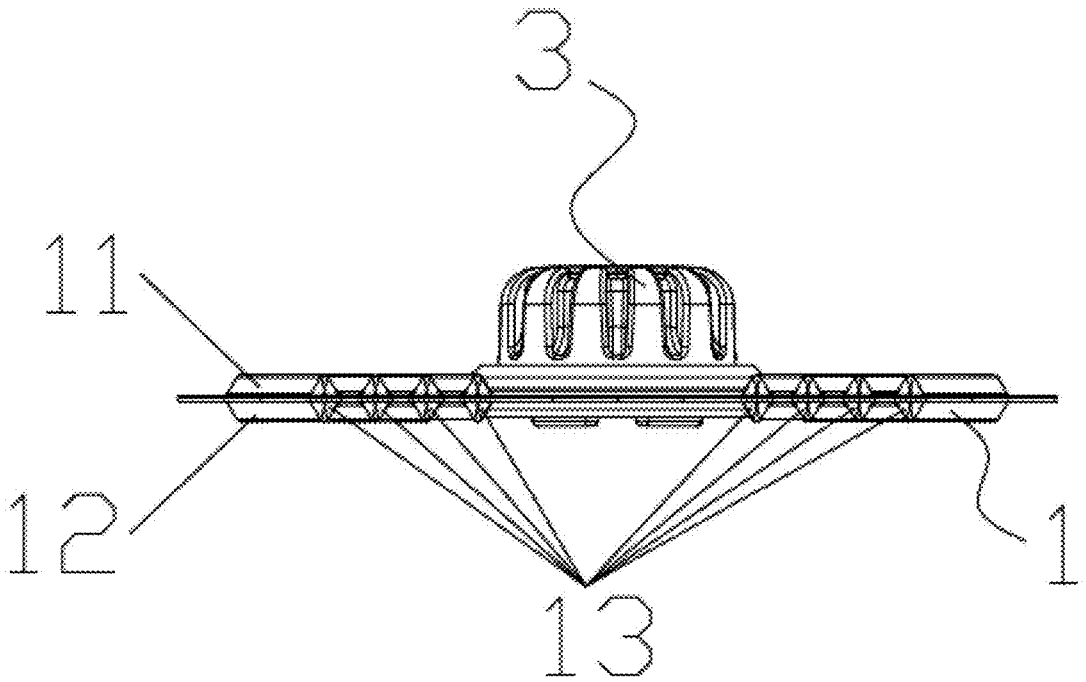
FIG. 2 is a front view of the air bag assembly of the present invention.
Figure 3:
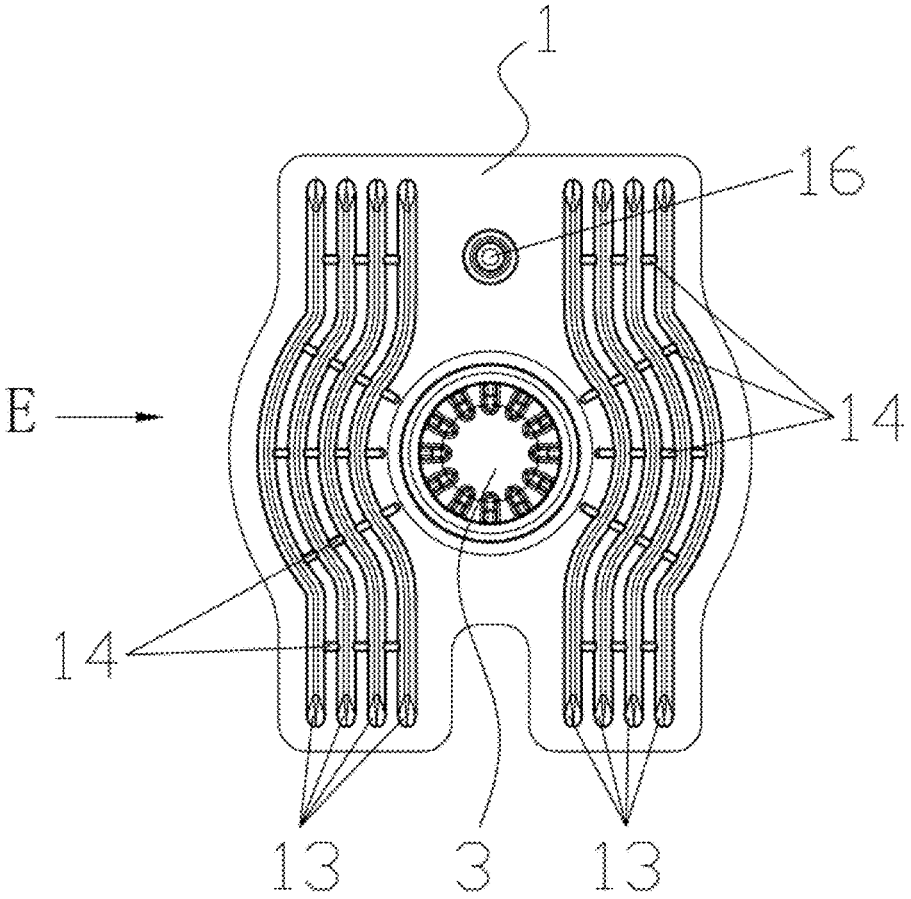
FIG. 3 is a top view of the air bag assembly of the present invention.
Figure 4:
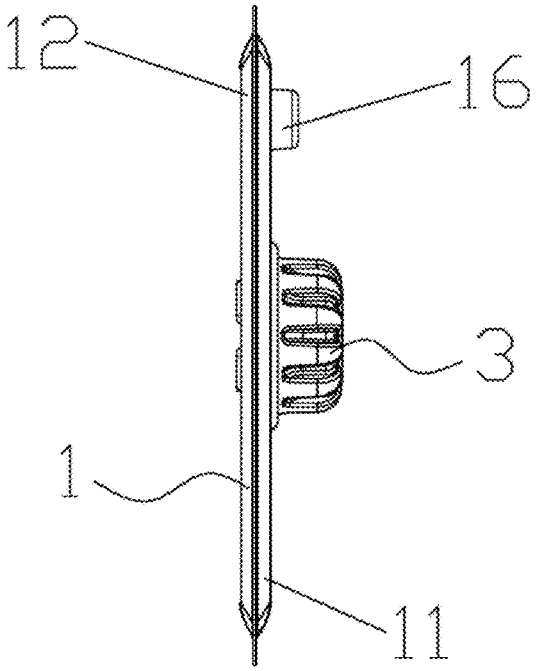
FIG. 4 is a diagram of the air bag assembly along E direction as shown in FIG. 3 of the present invention.
Figure 5:
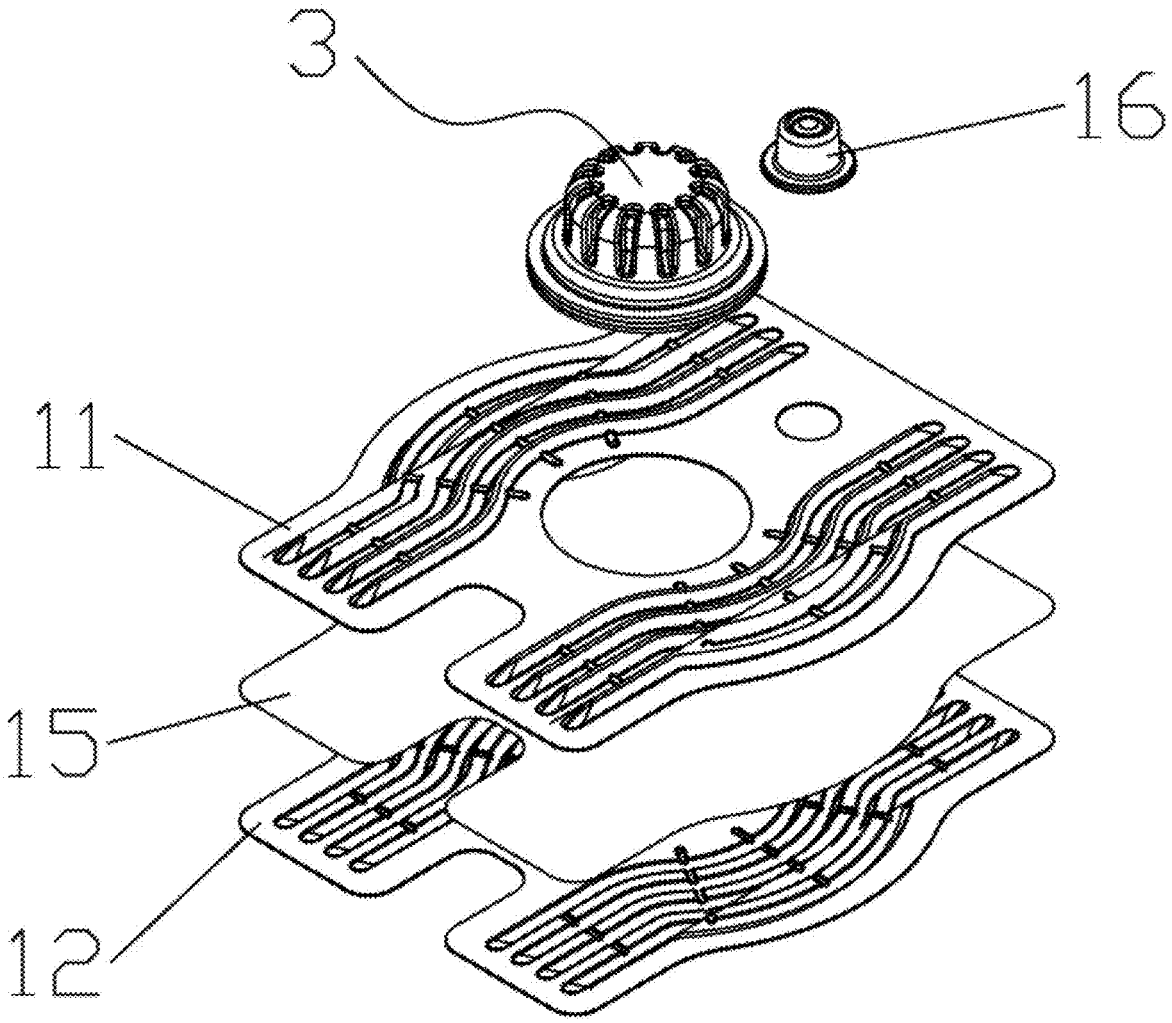
FIG. 5 is an exploded diagram of the air bag assembly of the present invention.
Figure 7:
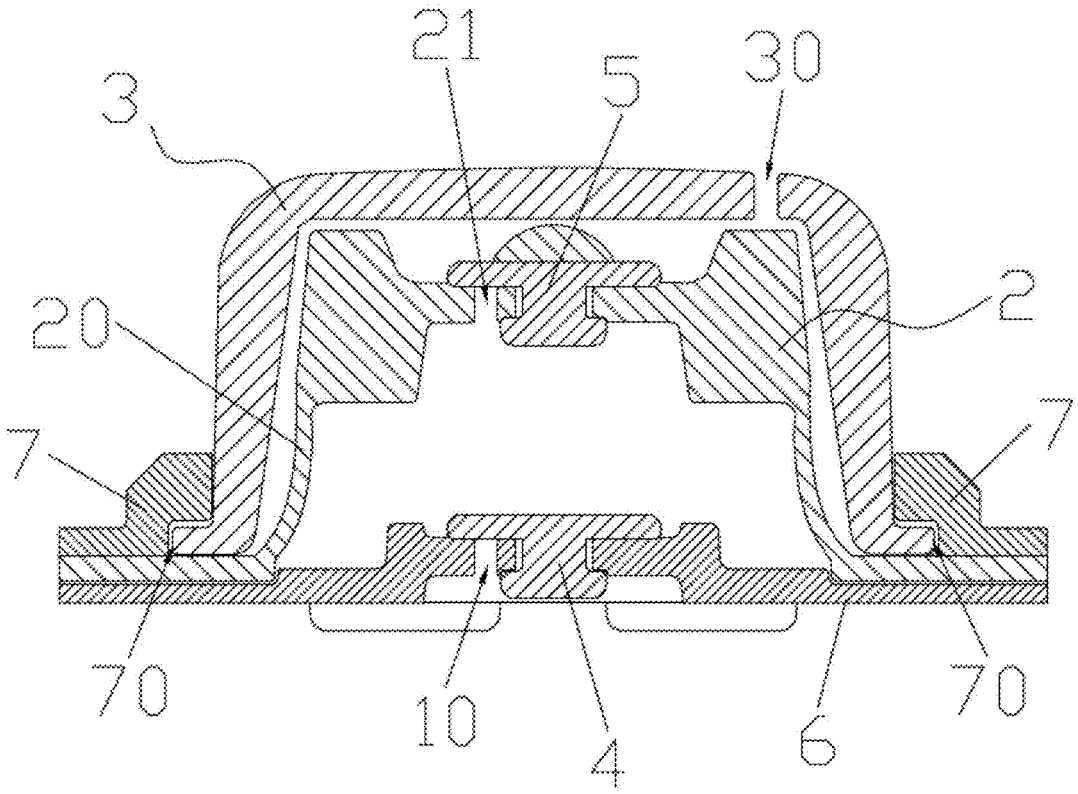
FIG. 7 is a sectional diagram of a rotary cover according to a first embodiment of the present invention.
Figure 8:
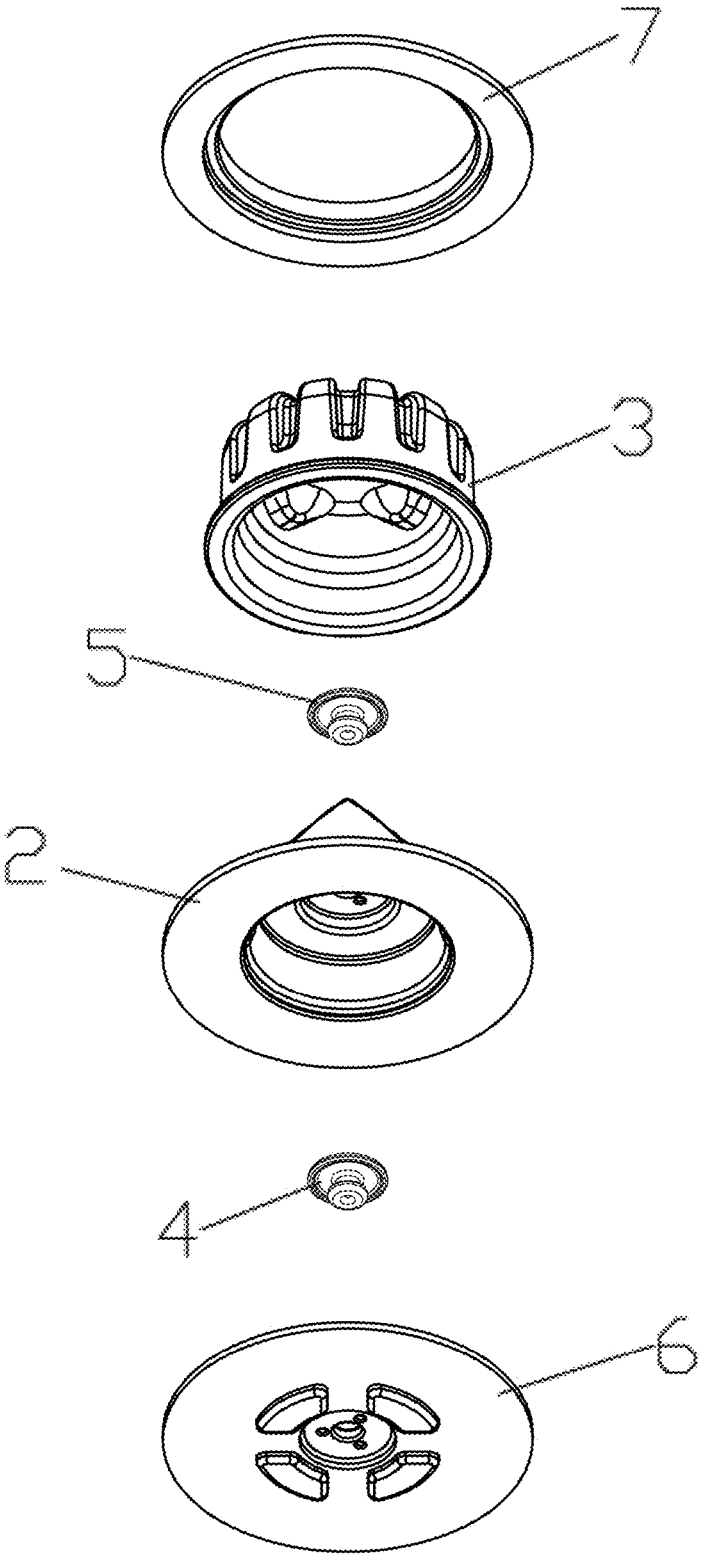
FIG. 8 and FIG. 9 are exploded diagrams of the rotary cover in different views according to the first embodiment of the present invention.
Figure 9:
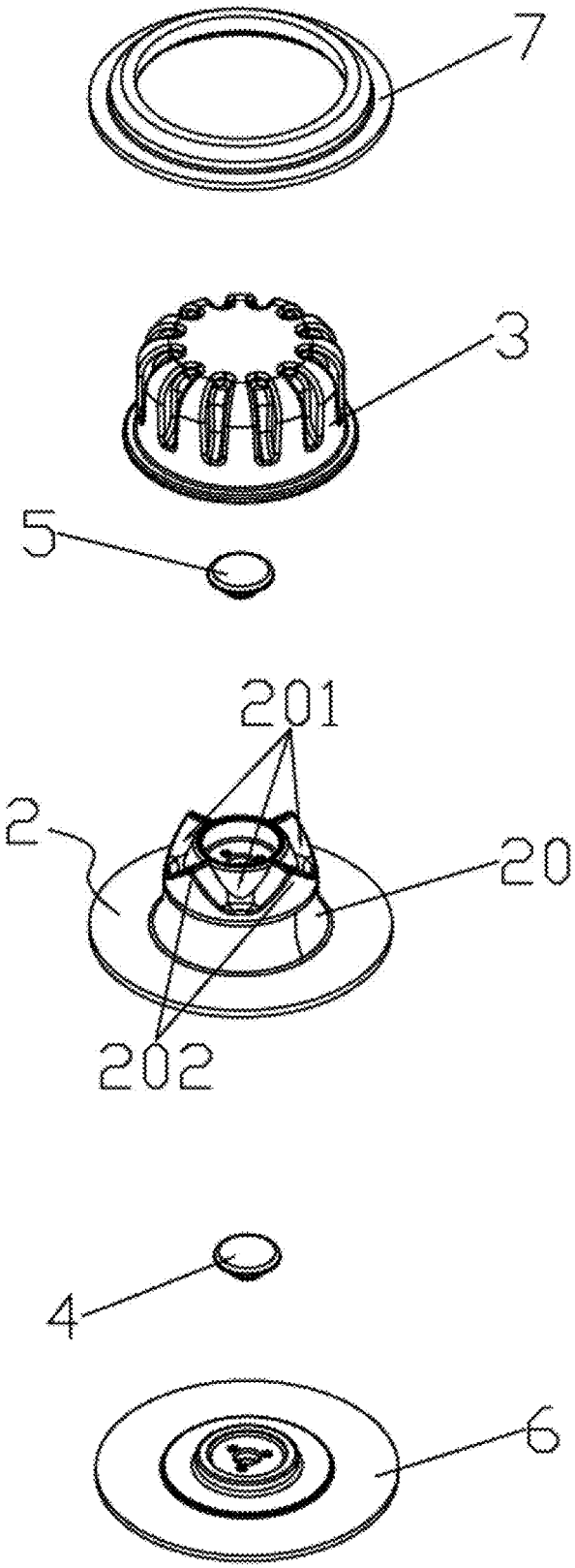

Please refer to FIG. 1 to FIG. 5 and FIG. 7 to FIG. 9. FIG. 1 is a schematic diagram of an air bag assembly of the present invention. FIG. 2 is a front view of the air bag assembly of the present invention. FIG. 3 is a top view of the air bag assembly of the present invention. FIG. 4 is a diagram of the air bag assembly along E direction as shown in FIG. 3 of the present invention. FIG. 5 is an exploded diagram of the air bag assembly of the present invention. FIG. 7 is a sectional diagram of a rotary cover 3 according to a first embodiment of the present invention. FIG. 8 and FIG. 9 are exploded diagrams of the rotary cover 3 in different views according to the first embodiment of the present invention. The air bag assembly includes an air bag 1, a suction pump 2, the rotary cover 3, a first check valve 4 and a second check valve 5.

A first hole 10 is formed on the air bag 1 and communicated with an interior of the air bag 1. The suction pump 2 is disposed outside the airbag 1 and covers the first air hole 10. A middle portion of the suction pump 2 bulges outwardly to form a pump body 20, and a peripheral edge of the pump body 20 is sealingly connected to the air bag 1. The pump body 20 is deformable and provided with a second air hole 21. An interior of the pump body 20 is communicated with the interior of the airbag 1 through the first air hole 10. A concave portion 201 and a convex portion 202 are formed on an outer surface of the pump body 20. The pump body 20 can be made of soft material.

The rotary cover 3 is disposed outside the suction pump 2. The rotary cover 3 has an air outlet 30 communicating with the second air hole 21, and a peripheral edge of the rotary cover 3 is sealingly connected to the airbag 1. A concave part and a convex part are formed on an inner surface of the rotary cover 3, the convex part of the rotary cover 3 and the concave portion 201 of the pump body 20 are configured to engage with each other, and the concave part of the rotary cover 3 and the convex portion 202 of the pump body 20 are configured to engage with each other. The rotary cover 3 is specifically formed in a shape of a cone, and the rotary cover 3 rotates about its central axis. The rotary cover 3 can have an anti-slip concave surface on the outer surface of the rotary cover 3 to prevent a hand from slipping when the rotary cover 3 is rotated. The rotary cover 3 can be made of hard material.

The first check valve 4 controls opening and closing of the first air hole 10 and further only allows air to enter into the interior of the pump body 20 from the interior of the air bag 1 through the first air hole 10 as the first air hole 10 is open.

The second check valve 5 controls opening and closing of the second air hole 21 and further only allows air to enter into an interior of the rotary cover 3 from the interior of the pump body 20 through the second air hole 21 as the second air hole 21 is open.

When the rotary cover 3 is rotated to make the convex part of the rotary cover 3 press the convex portion 202 of the pump body 20, the first check valve 4 closes the first air hole 10, the second check valve 5 opens the second air hole 21, and air inside the pump body 20 is sequentially discharged outside through the second air hole 21 and the air outlet 30. And then, when the rotating cover 3 is rotated to make the convex part of the rotary cover 3 embed in the concave portion 201 of the pump body 20 and make the convex portion 202 of the pump body 20 embed in the concave part of the rotary cover 3, the first check valve 4 opens the first air hole 10, the second check valve 5 closes the second air hole 21, and air inside the air bag 1 passes through the first air hole 10 to enter into the interior of the pump body 20, so as to pump the air bag 1 by rotating the rotary cover 3.

The operational process of the air bag assembly according to the first embodiment of the present invention is introduced as follows. First, the rotary cover 3 is rotated to make the convex part of the rotary cover 3 press the convex portion 202 of the pump body 20 so as to deform the pump body 20. Therefore, air inside the pump body 20 is compressed to increase the pressure, the second check valve 5 opens the second air hole 21, and the air inside the pump body 20 enters into the interior of the rotary cover 3 through the second air hole 21 and is discharged to the outside atmosphere through the air outlet 30. At this time, the first check valve 4 closes the first air hole 10.

Secondly, the rotating cover 3 is rotated to make the convex part of the rotary cover 3 embed in the concave portion 201 of the pump body 20 and make the convex portion 202 of the pump body 20 embed in the concave part of the rotary cover 3, so that the deformed pump body can be resiliently recovered, a shape of the pump body 20 is restored, and an internal volume of the pump body 20 is restored to form a negative pressure. Therefore, the first check valve 4 opens the first air hole 10, the air inside the air bag 1 passes through the first air hole 10 to enter into the interior of the pump body 20 so as to pump the air bag 1. At this time, the second check valve 5 closes the second air hole 21. In conclusion, by repeating the above-mentioned processes, the air bag 1 can be pumped by rotating the rotary cover 3 continuously.

Figure 10:
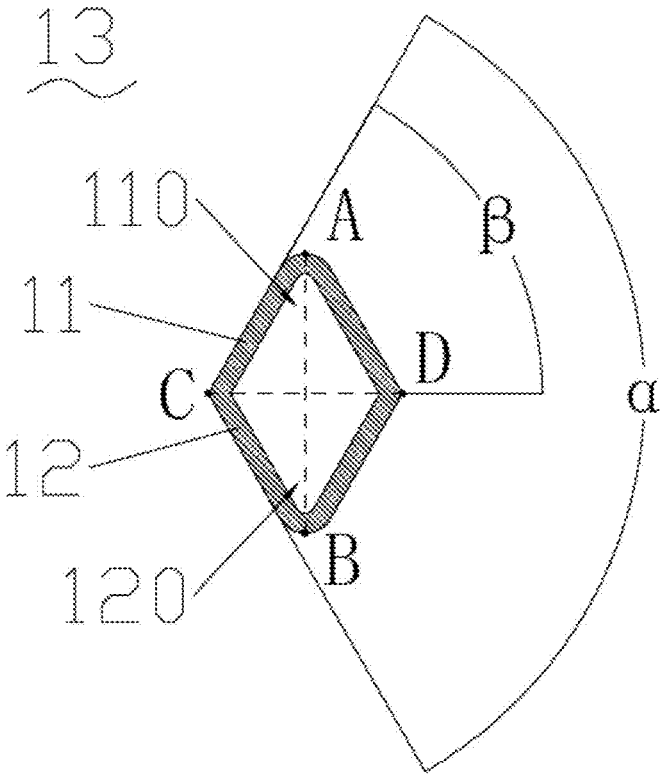
FIG. 10 is a sectional diagram of a sealing passage according to the first embodiment of the present invention.

In order to enable the airbag 1 to perform a deformable function during the pumping process, as shown in FIG. 5, the air bag 1 can be a flat sealing body formed by laminating an upper piece 11 and a lower piece 12. Please refer to FIG. 1 to FIG. 3, FIG. 5 to FIG. 6 and FIG. 10. FIG. 10 is a sectional diagram of a sealing passage 13 according to the first embodiment of the present invention. The upper piece 11 can be bent to form at least one inverted V-shaped groove 110, the lower piece 12 can be bent to format least one V-shaped groove 120 corresponding to the at least one inverted V-shaped groove 110. That is, the at least one inverted V-shaped groove 110 can be equal in number to the number of the at least one V-shaped groove 120. A notch of each of the at least one inverted V-shaped groove 110 and a notch of the corresponding V-shaped groove 120 face and are engaged with each other to form the sealing passage 13 having a rhombic cross section, and the sealing passage 13 is connected to the first air hole 10.

Please refer to FIG. 10. It is experimentally verified that a diagonal length AB of the rhombic cross section vertical to the air bag 1 is greater than a diagonal length CD of the rhombic cross section parallel to the air bag 1, that is, $\alpha>90°$, $\beta<45°$, when the interior of the sealing passage 13 is at a normal pressure. The rhombic cross section can be laterally contracted along the diagonal CD when pumping, the sealing passage 13 can be laterally actuated, and the air bag 1 can realize lateral expansion and contraction. The pumping amount of the air bag 1 can be adjusted for achieving the function of adjusting the tightness. If the diagonal length AB of the rhombic cross section vertical to the air bag 1 is less than or equal to the diagonal length CD of the rhombic cross section parallel to the air bag 1, that is, $\alpha\leq90°$, $\beta\geq45°$, the rhombic cross section can be laterally expanded along the diagonal AB when pumping, and the sealing passage 13 cannot be laterally actuated, so that the air bag 1 cannot achieve the expansion and contraction.

Further, it is experimentally verified that if the diagonal length AB of the rhombic cross section vertical to the air bag 1 is greater than or equal to $\sqrt{3}$ times the diagonal length CD of the rhombic cross section parallel to the air bag 1, that is, $\alpha\geq120°$, $\beta\geq60°$, when the interior of the sealing passage 13 is at the normal pressure, a lateral movement amplitude of the sealing passage 13 can be further increased, so as to facilitate the expansion and contraction of the air bag 1.

Specifically, a plurality of the sealing passages 13 can be spaced on the air bag 1, and two adjacent sealing passages 13 are parallel to each other. Therefore, the air bag 1 can be contracted in a direction perpendicular to the sealing passage 13 when being exhausted, and the air bag 1 can be expanded in the direction perpendicular to the sealing passage 13 when being inflated.

Preferably, eight sealing passages 13 can be formed on the air bag 1, and the eight sealing passages 13 are divided into two groups, that is, each group is composed of four sealing passages 13. The two groups of the sealing passages 13 are symmetrically disposed on both sides of the rotary cover 3.

In each group of the sealing passages 13, the four sealing passages 13 are spaced apart and parallel to one another. Central segments of the sealing passages 13 are curved in conformity with an arc-shaped contour of the rotary cover 3, and the four sealing passages 13 communicate with one another through channels 14 perpendicular to the sealing passages 13, as shown in FIG. 3. The sealing passages 13 also communicate with the first air hole 10 through channels. All of the sealing passages 13, the channels communicating with the sealing passages 13 and the first air hole 10, and the channels 14 communicating between the sealing passages 13 cooperatively constitute an internal space of the air bag 1.

In order to accelerate the circulation of the air between the first air hole 10 and the sealing passages 13 and to accelerate the circulation of the air between the sealing passages 13, a gauze layer 15 is disposed between the upper piece 11 and the lower piece 12, as shown in FIG. 5. In order to facilitate the recovery of the internal pressure of the air bag 1 to the normal pressure, a venting valve 16 is disposed on the air bag 1. When the venting valve 16 is open, the interior of the air bag 1 communicates with the outside atmosphere via the venting valve 16, so that the air bag 1 with the internal negative pressure can be inflated.

In order to improve air tightness and assembly compactness, the air bag assembly of the present invention can further include a bottom pad 6 and a collar 7. As shown in FIG. 5, an opening is formed on a middle portion of the upper piece 11 of the air bag 1. The bottom pad 6 can be a circular pad and covers the opening, and a peripheral bottom surface of the bottom pad 6 is sealingly connected with an outer surface of the upper piece 11 to seal the opening. The first air hole 10 can be formed on a portion of the bottom pad 6 covering the opening, as shown in FIG. 7. The first check valve 4 is installed in the middle portion of the bottom pad 6.

The first check valve 4 can be a silicone check valve. When the internal pressure of the pump body 20 is greater than the internal pressure of the air bag 1, the internal air of the pump body 20 presses down the first check valve 4, so that the first check valve 4 closes the first air hole 10. When the internal pressure of the pump body 20 is less than the internal pressure of the air bag 1, the internal air of the air bag 1 opens the first check valve 4 to enter into the interior of the pump body 20 through the first air hole 10. When the internal pressure of the pump body 20 is equal to the internal pressure of the air bag 1, the first check valve 4 is opened or closed.

A bottom surface of a peripheral portion of the suction pump 2 is sealingly connected to a surface of the bottom pad 6 to achieve sealing connection with the air bag 1. The second air hole 21 is formed on a top portion of the pump body 20, and the second check valve 5 is installed on the top portion of the pump body 20. Specifically, an outer surface of the top portion of the pump body 20 is recessed toward the inside of the pump body 20 to form a recess, and the second check valve 5 is installed in the recess.

The second check valve 5 can be a silicone check valve. When the internal pressure of the pump body 20 is greater than the internal pressure of the rotary cover 3 (i.e. atmospheric pressure), the internal air of the pump body 20 opens the second check valve 5 to enter into the interior of the rotary cover 3 through the second check valve 5. When the internal pressure of the pump body 20 is less than the internal pressure of the rotary cover 3 (i.e. atmospheric pressure), the internal pressure of the rotary cover 3 (i.e. atmospheric pressure) presses down the second check valve 5, so that the second check valve 5 closes the second air hole 21. When the internal pressure of the pump body 20 is equal to the internal pressure of the rotary cover 3, the second check valve 5 is opened or closed.

The collar 7 can be a circular collar sleeving on the periphery of the rotating cover 3, and a bottom portion of the collar 7 is sealingly connected to a peripheral surface of the suction pump 2. An annular installation groove 70 is disposed on an inner side of the collar 6. A bottom of the rotary cover 3 is engaged into the annular installation groove 70 to form a sealing space between an inner side wall of the rotary cover 3 and the outer surface of the pump body 20. The air outlet 30 is formed on a top portion of the rotary cover 3.

The rotary cover 3 can be made of hard plastic material. The suction pump 2 can be made of silicone material. The bottom pad 6 can be made of soft material, such as silicone material or the like. The air bag 1 can be made of airtight and flexible material, such as a plastic cloth or the like. The collar 7 can be made of hard plastic material. The suction pump 2, the bottom pad 6 and the air bag 1 can be connected by heat fusion or adhesive bonding to achieve sealing connection of the corresponding portions.

In this embodiment, four convex portions 202 are spaced around the recess on the outer surface of the top portion of the pump body 20, and each concave portion 201 is disposed between the two adjacent convex portions 202, such that there are four concave portions 201 accordingly as shown in FIG. 8 and FIG. 9. Correspondingly, four concave parts (not shown in figures) are disposed on an inner surface of the rotary cover 3 and are opposite to the four convex portions 202, that is, the shape and the location of the four concave parts of the rotary cover 3 correspond to ones of the four convex portions 202. Similarly, four convex parts (not shown in figures) are disposed on the inner surface of the rotary cover 3 and are opposite to the four concave portions 201, that is, the shape and the location of the four convex parts of the rotary cover 3 correspond to ones of the four concave portions 201. When the convex parts of the rotary cover 3 and the concave portions 201 of the pump body 20 cooperate with each other and the concave parts of the rotary cover 3 and the convex portions 202 of the pump body 20 cooperate with each other, the pump body 20 is not pressed by the rotary cover 3. When the convex parts of the rotary cover 3 press the convex portions 202 of the pump body 20, the pump body 20 is pressed by the rotary cover 3 and the internal volume of the pump body 20 is compressed.

Besides the pump body and the rotary cover of the above-mentioned embodiment, concave and convex points with different numbers and different arrangements can be disposed between the outer surface of the pump and the inner surface of the rotary cover, as long as the rotary cover can be rotated to a specific position for pressing the pump body.

Figure 11:
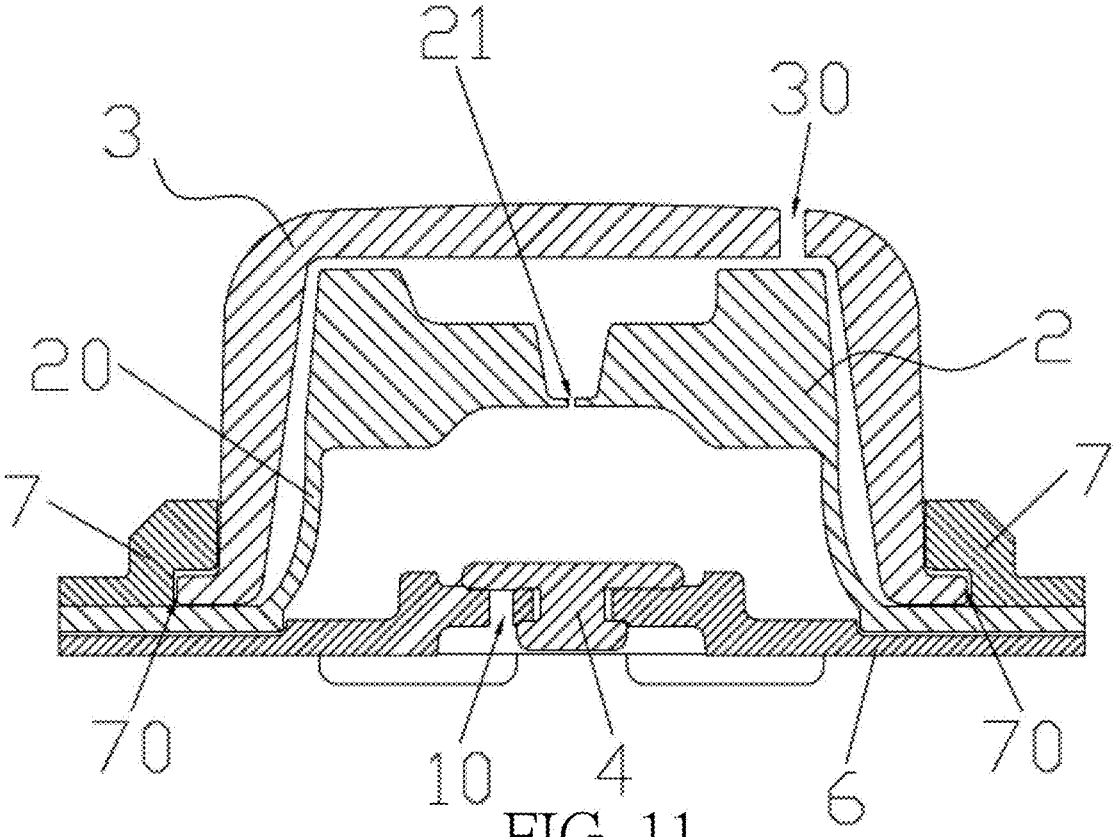
FIG. 11 is a sectional diagram of the air bag assembly according to a second embodiment of the present invention.
Figure 12:
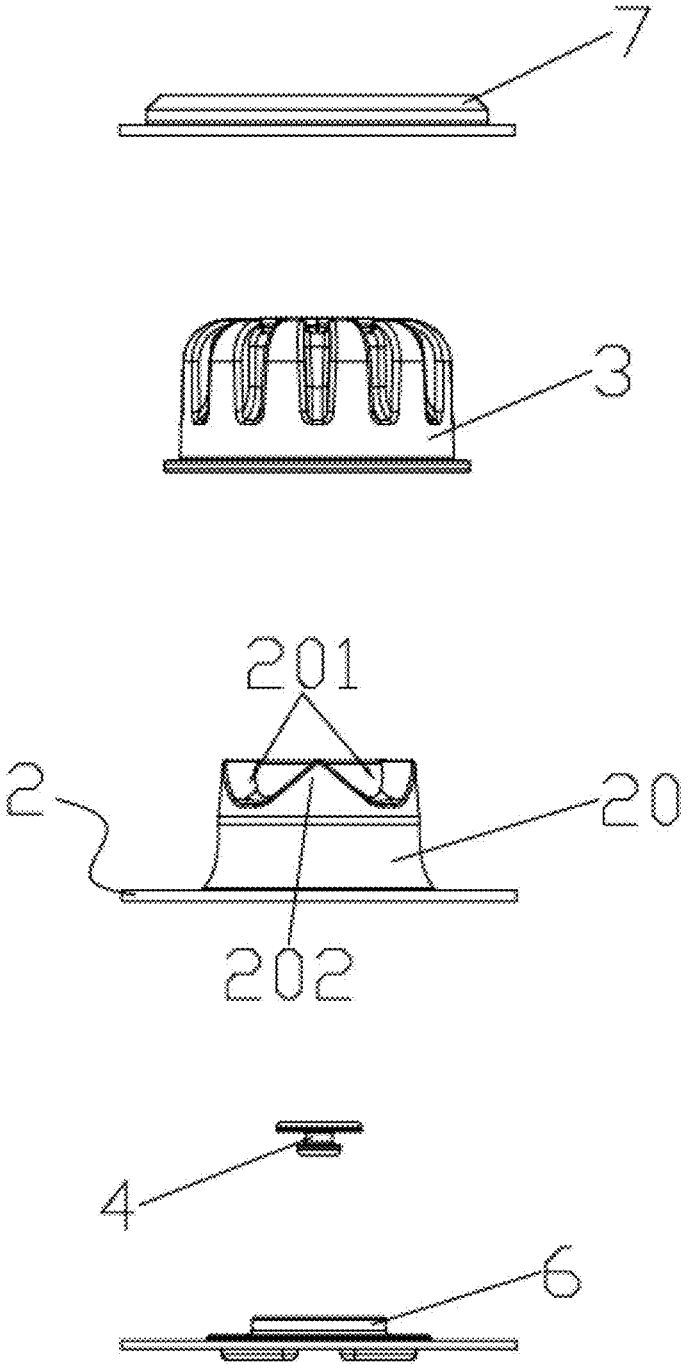
FIG. 12 and FIG. 13 are exploded diagrams of the rotary cover in different views according to the second embodiment of the present invention.
Figure 13:
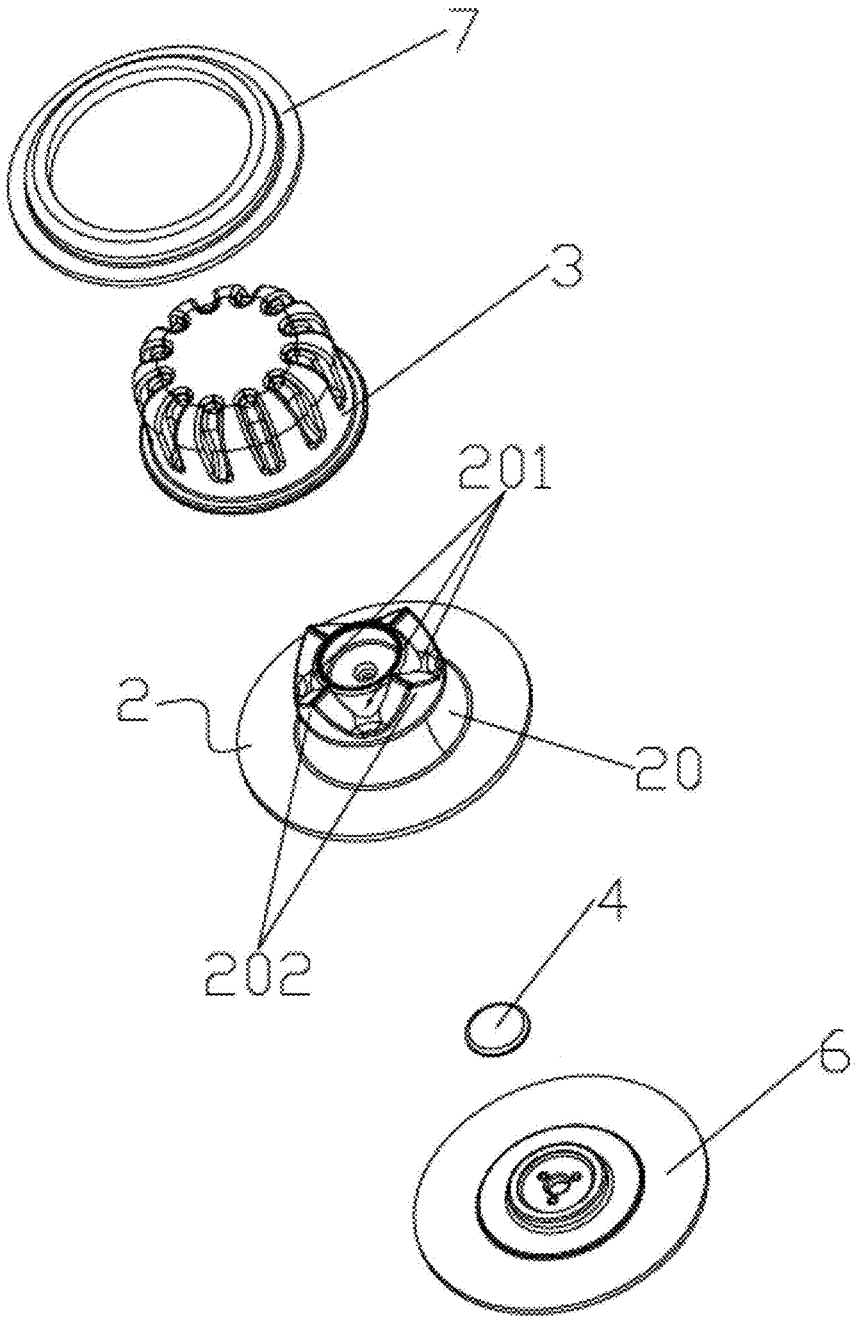

Please refer to FIG. 11 to FIG. 13. FIG. 11 is a sectional diagram of the air bag assembly according to a second embodiment of the present invention. FIG. 12 and FIG. 13 are exploded diagrams of the rotary cover 3 in different views according to the second embodiment of the present invention. The air bag assembly according to the second embodiment is basically similar to the airbag assembly according to the second embodiment, and differences between the first embodiment and the second embodiment are that the second check valve 5 is not provided according to the second embodiment, and a diameter of the first air hole 10 is larger than a diameter of the second air hole 21 according to the second embodiment.

When the rotary cover 3 is rotated to make the convex part of the rotary cover 3 press the convex portion 202 of the pump body 20, the first check valve 4 closes the first air hole 10, and the air inside the pump body 20 is sequentially discharged outside through the second air hole 21 and the air outlet 30. And then, when the rotating cover 3 is rotated to make the convex part of the rotary cover 3 embed in the concave portion 201 of the pump body 20 and make the convex portion 202 of the pump body 20 embed in the concave part of the rotary cover 3, the first check valve 4 opens the first air hole 10, the air inside the air bag 1 passes through the first air hole 10 to enter into the interior of the pump body 20, and ambient air in the outside atmosphere enters into the interior of the pump body 20 through the air outlet 30 and the second air hole 21, so as to pump the air bag 1 by rotating the rotary cover 3.

The operational process of the air bag assembly according to the second embodiment of the present invention is introduced as follows. First, the rotary cover 3 is rotated to make the convex part of the rotary cover 3 press the convex portion 202 of the pump body 20 so as to deform the pump body 20. Therefore, the air inside the pump body 20 is compressed to increase the pressure, and the air inside the pump body 20 enters into the interior of the rotary cover 3 through the second air hole 21 and is discharged to the outside atmosphere through the air outlet 30. At this time, the first check valve 4 closes the first air hole 10.

Secondly, the rotating cover 3 is rotated to make the convex part of the rotary cover 3 embed in the concave portion 201 of the pump body 20 and make the convex portion 202 of the pump body 20 embed in the concave part of the rotary cover 3, so that the deformed pump body can be resiliently recovered, the shape of the pump body 20 is restored, and the internal volume of the pump body 20 is restored to form the negative pressure. Therefore, the first check valve 4 opens the first air hole 10, the air inside the air bag 1 passes through the first air hole 10 to enter into the interior of the pump body 20 so as to pump the air bag 1. At this time, the ambient air in the outside atmosphere also enters into the interior of the pump body 20 through the air outlet 30 and the second air hole 21 (air backflow). Since the diameter of the second air hole 21 is smaller than the diameter of the first air hole 10, it is advantageous to reduce air backflow to the interior of the pump body 20 and makes more air inside the air bag 1 pump to the interior of the pump body 20. In conclusion, by repeating the above-mentioned processes, the air bag 1 can be pumped by rotating the rotary cover 3 continuously.

Preferably, the air outlet 30 according to the second embodiment can have a diameter of 0.2 mm to 0.4 mm, which can reduce the speed of the ambient air in the outside atmosphere flowing back into the interior of the pump body 20 through the air outlet 30 and facilitate more air inside the air bag 1 to pump into the interior of the pump body 20.

In the airbag assembly according to the first embodiment, the air flow direction is controlled by the first check valve 4 and the second check valve 5 in the same direction, and the second check valve 5 can prevent the outside air from flowing back to the interior of the pump body 20. When the shape of the pump body 20 is restored, only the air inside the air bag 1 enters into the interior of the pump body 20, which makes the vacuum suction force of the pump body 20 on the air bag 1 larger and makes the air pumping speed of the airbag 1 faster. But when the internal vacuum of the airbag 1 reaches the limit, the pump body 20 is sucked. Since there is no outside air flowing back, the shape of the pump body 20 cannot be recovered. Only after opening the venting valve 16 or the like for returning air into the interior of the airbag 1, the sucked pump body 20 can be restored in shape. Furthermore, if the first check valve 4 and the second check valve 5 according to the first embodiment are arranged reversely, the air bag 1 can be inflated when the rotary cover 3 is rotated.

In the air bag assembly according to the second embodiment, only the first check valve 4 is provided. When the shape of the pump body 20 is restored, the outside air and the air inside the air bag 1 enter into the interior of the pump body 20, which makes the vacuum suction force of the pump body 20 on the air bag 1 smaller than the one of the first embodiment and makes the air pumping speed of the air bag 1 slower than the one of the first embodiment. By structural design that the diameter of the first air hole 10 is larger than the diameter of the second air hole 21, it can reduce the air backflow to the interior of the pump body 20 and make more air inside the air bag 1 pump to the interior of the pump body 20 to enhance the pumping effect of the air bag 1. Since the outside air can flow back to the interior of the pump body 20, the shape of the pump body 20 can always be restored.

Figure 6:
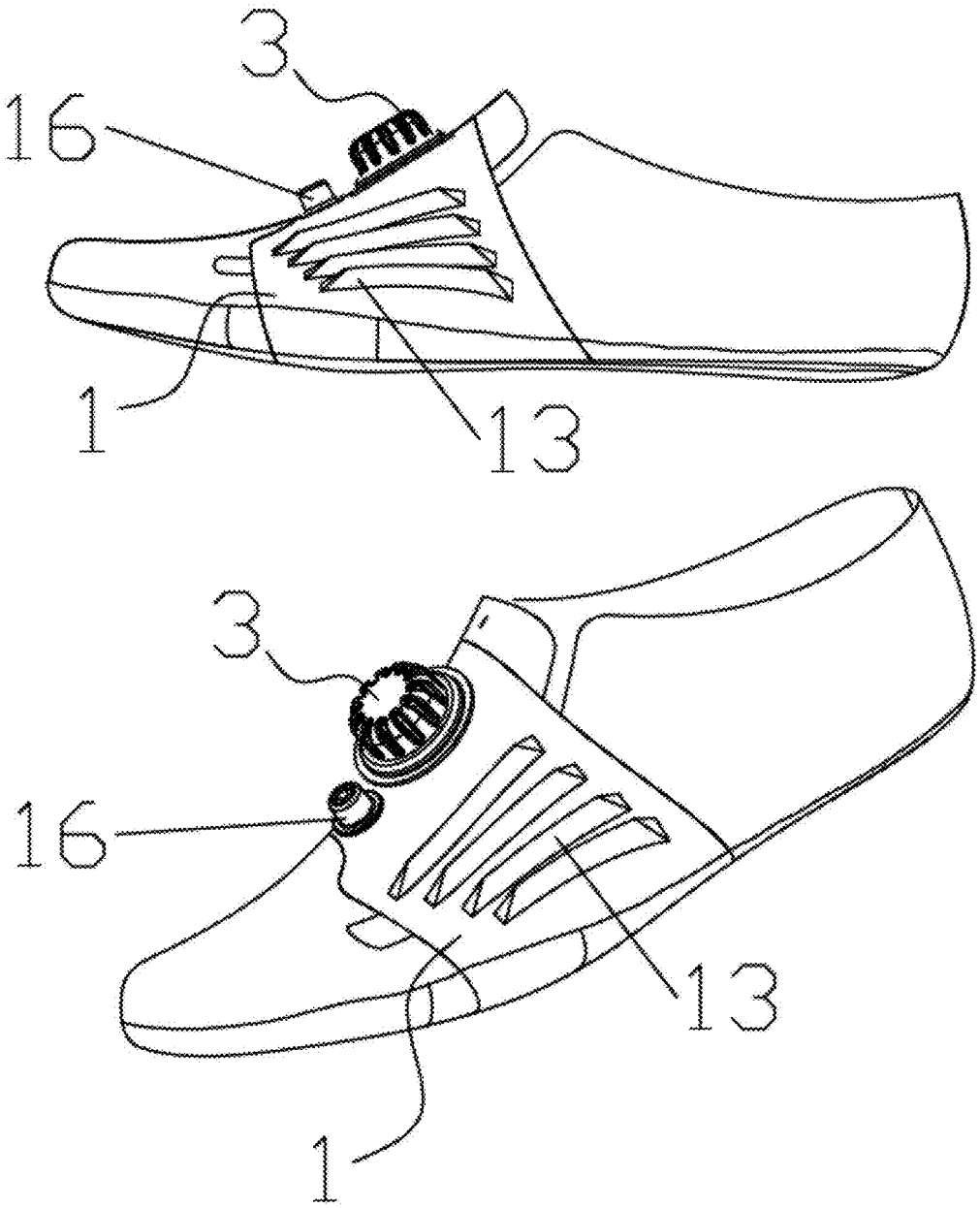
FIG. 6 is a diagram of the air bag assembly applied for shoes of the present invention.

The air bag assembly of the present invention can be applied to conditions where air suction is required. For example, it can vacuum a clothes storage bag. If an air bag having a sealing passage is used, the air bag assembly can be used for clothing, shoes, bags, watch belts, and related wearable accessories, so as to provide functions of the expansion and contraction. Please refer to FIG. 6. FIG. 6 is a diagram of the air bag assembly applied for shoes of the present invention. The air bag assembly can be installed on a shoe, and the air bag is connected with lateral sides of the shoe. Therefore, the tightness of the shoe can be adjusted by adjusting the air pumping amount of the air bag, so that the shoe can be attached to a foot surface, which ensures the safety of the ankle.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An air bag assembly comprising:

an air bag whereon a first hole is formed;

a suction pump disposed outside the air bag and covering the first air hole, a middle portion of the suction pump bulging outwardly to form a pump body, a peripheral edge of the pump body sealingly being connected to the air bag, the pump body being deformable and provided with a second air hole, an interior of the pump body being communicated with an interior of the air bag through the first air hole, and a concave portion and a convex portion being formed on an outer surface of the pump body;

a rotary cover disposed outside the suction pump, the rotary cover comprising an air outlet communicating with the second air hole, a peripheral edge of the rotary cover being sealingly connected to the air bag, a concave part and a convex part being formed on an inner surface of the rotary cover, the convex part and the concave portion being configured to engage with each other, and the concave part and the convex portion being configured to engage with each other; and a first check valve for controlling opening and closing of the first air hole and further for only allowing air to enter into the interior of the pump body from the interior of the air bag through the first air hole;

wherein when the rotary cover is rotated to make the convex part press the convex portion, the first check valve closes the first air hole, and air inside the pump body is sequentially discharged through the second air hole and the air outlet hole, and when the rotary cover is rotated to make the convex part embed in the concave portion and make the convex portion embed in the concave part, the first check valve opens the first air hole, and air inside the air bag passes through the first air hole to enter into the interior of the pump body, so as to pump the air bag by rotating the rotary cover.

2. The air bag assembly of claim 1, further comprising a second check valve for controlling opening and closing of the second air hole and further for only allowing air to enter into an interior of the rotary cover from the interior of the pump body through the second air hole.

3. The air bag assembly of claim 1, wherein a diameter of the first air hole is larger than a diameter of the second air hole.

4. The air bag assembly of claim 1, wherein the air bag is a flat sealing body formed by laminating an upper piece and a lower piece, the upper piece is bent to form at least one inverted V-shaped groove, the lower piece is bent to form at least one V-shaped groove corresponding to the at least one inverted V-shaped groove, a notch of each of the at least one inverted V-shaped groove and a notch of the corresponding V-shaped groove are engaged with each other to form at least one sealing passage having a rhombic cross section, and the at least one sealing passage is connected to the first air hole.

5. The air bag assembly of claim 4, wherein a diagonal length of the rhombic cross section vertical to the air bag is greater than a diagonal length of the rhombic cross section parallel to the air bag when an interior of the at least one sealing passage is at a normal pressure.

6. The air bag assembly of claim 5, wherein the diagonal length of the rhombic cross section vertical to the air bag is greater than or equal to $\sqrt{3}$ times the diagonal length of the rhombic cross section parallel to the air bag when the interior of the at least one sealing passage is at the normal pressure.

7. The air bag assembly of claim 4, wherein a plurality of the sealing passages are spaced on the air bag, and two adjacent sealing passages are parallel to each other.

8. The air bag assembly of claim 4, wherein a gauze layer is disposed between the upper piece and the lower piece.

9. The air bag assembly of claim 1, wherein the suction pump is made of silicone material.

10. The air bag assembly of claim 1, wherein a venting valve is disposed on the air bag.

* * * * *